US006952543B2

(12) United States Patent
Kusudo

(10) Patent No.: US 6,952,543 B2
(45) Date of Patent: Oct. 4, 2005

(54) IMAGE FORMING APPARATUS, PROCESS CARTRIDGE, AND ELECTRODE MEMBER

(75) Inventor: Ryoji Kusudo, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/665,424

(22) Filed: Sep. 22, 2003

(65) Prior Publication Data

US 2004/0057745 A1 Mar. 25, 2004

(30) Foreign Application Priority Data

Sep. 25, 2002 (JP) ..... 2002-279374

(51) Int. Cl.[7] ..... G03G 15/00
(52) U.S. Cl. ..... 399/90; 399/111; 399/119
(58) Field of Search ..... 399/37, 88, 90, 399/107, 110, 111, 119, 265; 174/59; 439/188, 526, 924.1

(56) References Cited

U.S. PATENT DOCUMENTS 5,283,619 A * 2/1994 Nomura et al. ..... 399/90
5,634,175 A * 5/1997 Michlin et al. ..... 399/90
6,151,465 A * 11/2000 Toba et al. ..... 399/90
6,473,578 B2 10/2002 Miyabe et al. ..... 399/119
2001/0024581 A1 9/2001 Miyabe et al.

FOREIGN PATENT DOCUMENTS

JP 2001-201996 7/2001

* cited by examiner

*Primary Examiner*—Hoang Ngo
(74) *Attorney, Agent, or Firm*—Fitzpatrick, Cella, Harper & Scinto

(57) ABSTRACT

An electrode member is used for supplying power from an image forming apparatus body to a developing roller of a process cartridge when the process cartridge, detachably attachable to the apparatus body, is attached to the apparatus body. The electrode member includes a conductive substrate, and a hole provided in the substrate. The hole includes a groove and an end portion and the width of the end portion of the hole is larger than the width of the groove. The electrode member also includes an elastic portion bent and raised along the hole so that an electrode is able to contact the elastic portion. The electrode member also includes a rib provided opposite and along the end of the hole, an engagement hole for mounting the electrode member to a bearing of the developing roller, and a contact portion making contact with an inner surface of the developing roller, when the electrode member is mounted to the bearing.

9 Claims, 11 Drawing Sheets

IMAGE FORMING APPARATUS, PROCESS CARTRIDGE, AND ELECTRODE MEMBER

FIELD OF THE INVENTION AND RELATED ART

The present invention relates to an image forming apparatus such as a copier or a printer, and a process cartridge detachably attachable to the image forming apparatus, and an electrode member.

Image forming apparatuses using electrophotography require replacement of photosensitive drums, replenishment of developers, and adjustment, cleaning and replacement of electrifiers or cleaner containers after long periods of use. Such maintenance has been performed by service technicians.

Thus, process cartridges have been manufactured that include image-forming-process means, such as a photosensitive drum, a developing apparatus and a cleaning apparatus, as a unit.

Such a process-cartridge system allows a user himself/herself to easily perform maintenance and replacement as required. This allows high quality images to be easily obtained at a low cost.

In the developing apparatus included in the process cartridge, toner evenly carried on a surface of a developing roller is supplied to a photosensitive drum in order to develop an electrostatic latent image formed on the photosensitive drum. For this purpose, the developing roller is biased. Further, a configuration is known that saves longitudinal space of the developing apparatus, and allows accurate positioning of a magnetic roller. This configuration is such that an electrode axis that is secured to a side cover forming a housing of the process cartridge is abutted against a sleeve contact plate that is held rotatably with the developing roller and serves as an elastically deformable electrode member (Japanese Patent Application Laid-Open No. 2001-201996).

SUMMARY OF THE INVENTION

An object of the invention is to provide a process cartridge, an image forming apparatus and an electrode member, wherein the reliability of the electrode member is improved, the electrode member being used for the process cartridge to receive power from an image forming apparatus body, when the process cartridge is attached to the apparatus body.

Another object of the invention is to provide a process cartridge, an image forming apparatus and an electrode member, wherein the life of the electrode member is prolonged, the electrode member being used for the process cartridge to receive power from an image forming apparatus body, when the process cartridge is attached to apparatus body.

A further object of the invention is to provide an electrode member more resistant to fatigue caused by repeated vibration, and a process cartridge using the electrode member, and an image forming apparatus.

A further object of the invention is to provide an electrode member having a hole provided in a conductive substrate, an end of the hole being larger than a width of the hole, and a rib provided opposite and along the end of the hole, and a process cartridge using the electrode member, and an image forming apparatus.

DETAILED DESCRIPTION OF THE PREFERRED EMBODIMENTS

Embodiments of the invention will be described with reference to FIGS. 1 to 12.

[Description on Process Cartridge and Image Forming Apparatus Body]

Figure 1:
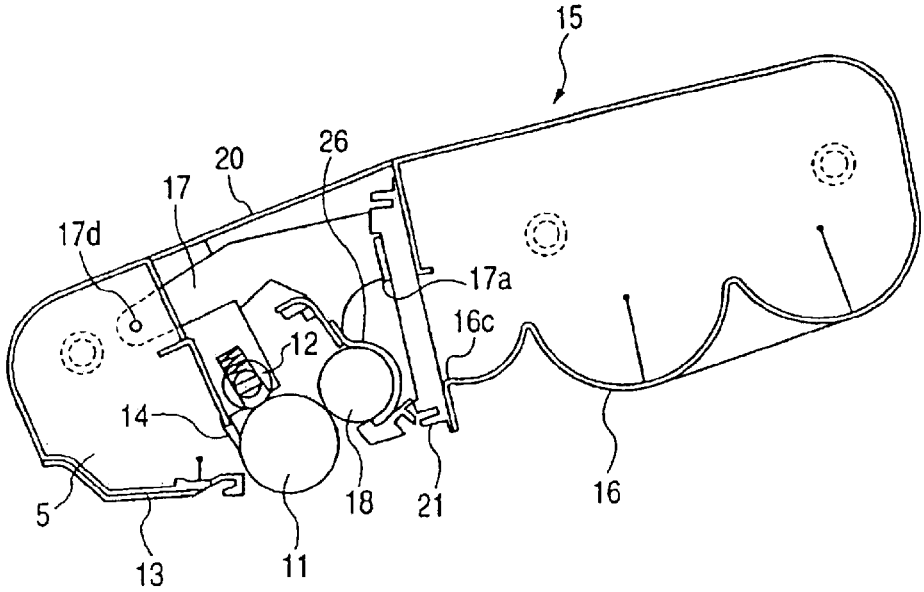
FIG. 1 is a main schematic sectional view of a process cartridge according to an embodiment of the invention.
Figure 2:
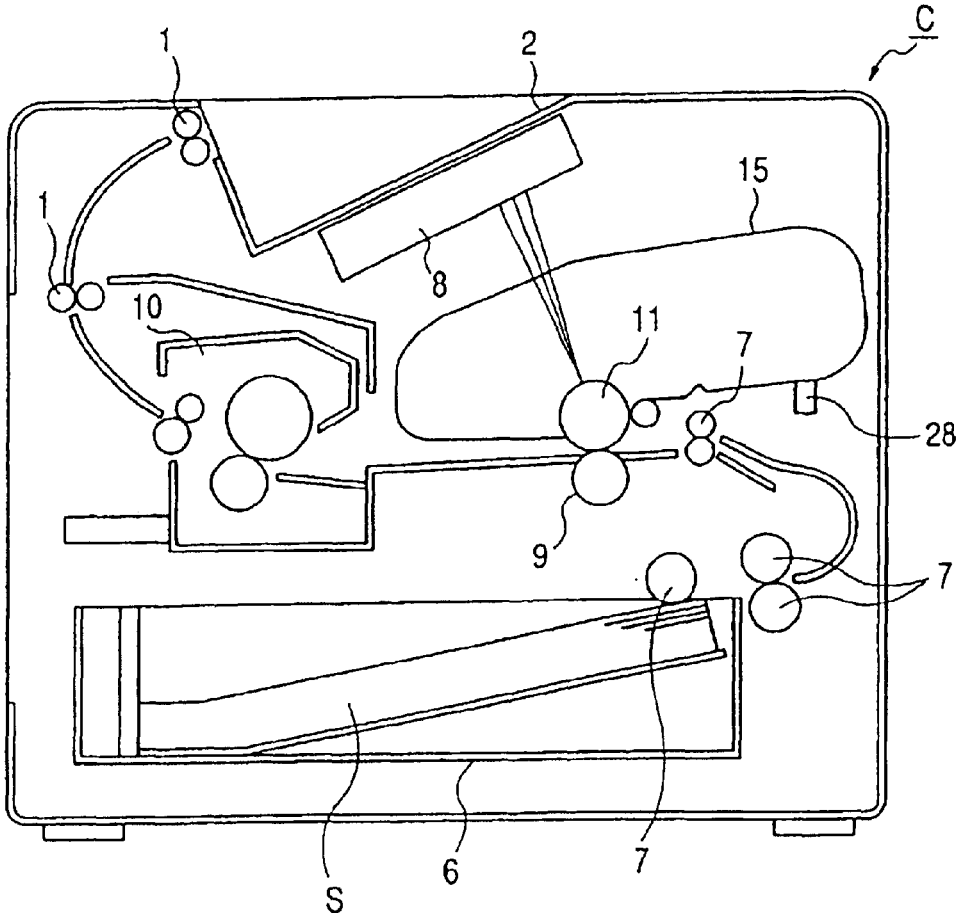
FIG. 2 is a schematic view of an image forming apparatus body in which the process cartridge in FIG. 1 is replaceable.

FIG. 1 is a main sectional view of a process cartridge according to an embodiment of the invention, and FIG. 2 is a main sectional view of an image forming apparatus according to the embodiment of the invention, in which the process cartridge shown in FIG. 1 is attached in a replaceable manner.

The process cartridge includes an electrophotographic photosensitive drum (hereinafter referred to as a photosensitive drum), and process means that operates on the photosensitive drum. The process means includes, for example, electrifying means that electrifies a surface of the photosensitive drum, a developing apparatus that forms a toner image on an electrostatic latent image of the photosensitive drum, and cleaning means that removes residual toner on the surface of the photosensitive drum.

In a process cartridge 15 according to the embodiment, an electrifying roller 12 functioning as the electrifying means, a developing roller 18, a developing blade and a toner containing frame 16 containing toner, functioning as the developing means, and a cleaning blade 14 functioning as cleaning means, are placed around a photosensitive drum 11 as shown in FIG. 1. These components are housed in a housing to form the cartridge 15 as a unit, which is detachably attachable to an image forming apparatus body C.

The process cartridge 15 is attached to the image forming apparatus body C as shown in FIG. 2, and used for image forming. In the image forming operation, a sheet S is conveyed by a conveying roller 7 from a cassette 6 attached to a lower portion of the apparatus. Synchronously with conveying the sheet, the photosensitive drum 11 is selectively exposed to light by an exposing apparatus 8 to form a latent image. Then, the toner contained in the toner containing frame 16 is carried in a thin layer on a surface of the developing roller 18 by the developing blade. A developing bias is then applied to the developing roller 18. Thus, the toner is supplied to the photosensitive drum 11, depending on the latent image. The toner image is transferred to the conveyed sheet S by application of a bias voltage to a transferring roller 9. Then, the sheet S is conveyed to a fixing apparatus 10 to fix the image on the sheet S. The sheet S is then ejected to an ejecting portion 2 in an upper portion of the apparatus by ejecting rollers 1.

[Frame Configuration of Process Cartridge]

Figure 3:
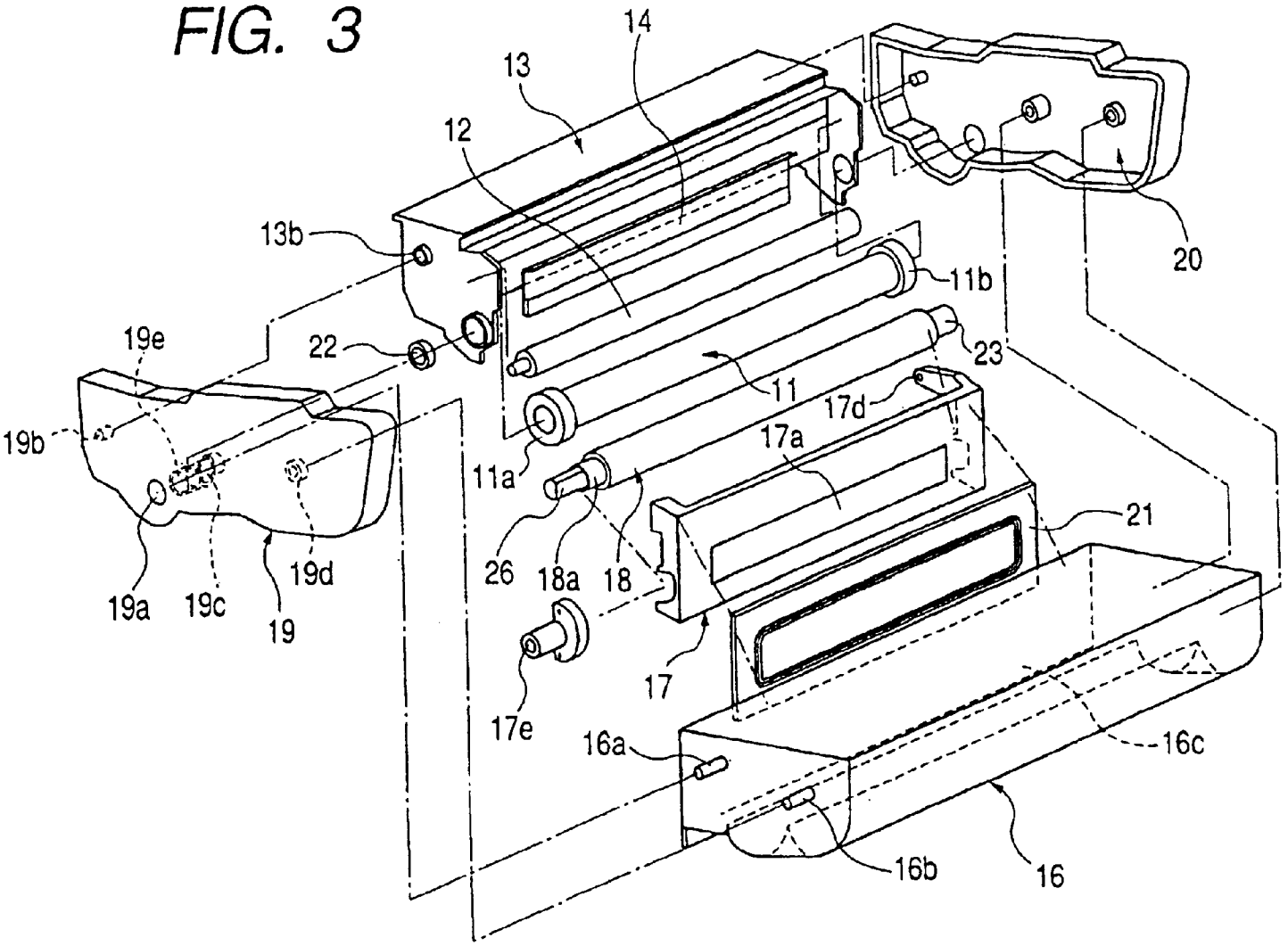
FIG. 3 is an exploded perspective view of a frame of the process cartridge in FIG. 1.
Figure 4:
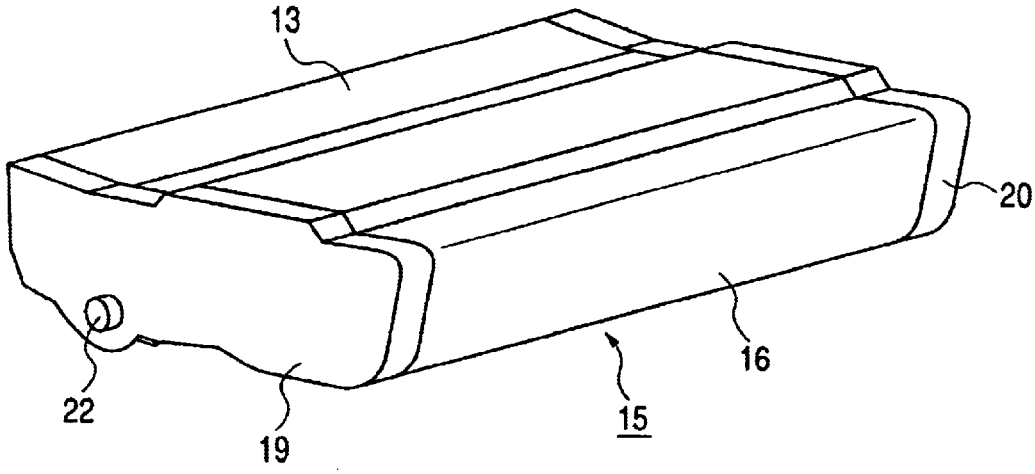
FIG. 4 is a perspective view of the appearance of the frame of the process cartridge in FIG. 1.
Figure 5:
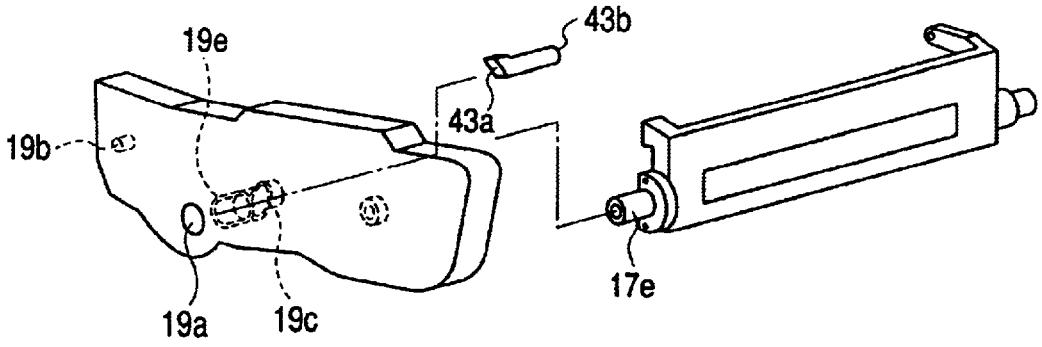
FIG. 5 is a perspective view of a developing frame of the process cartridge in FIG. 1.
Figure 6:
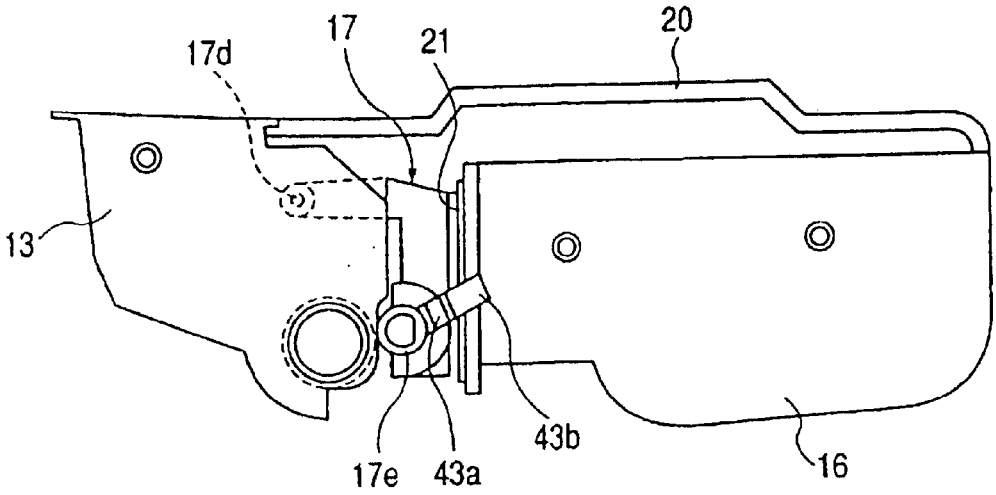
FIG. 6 is a front view of a non-driven side of the process cartridge in FIG. 1 before a side cover is attached.
Figure 7:
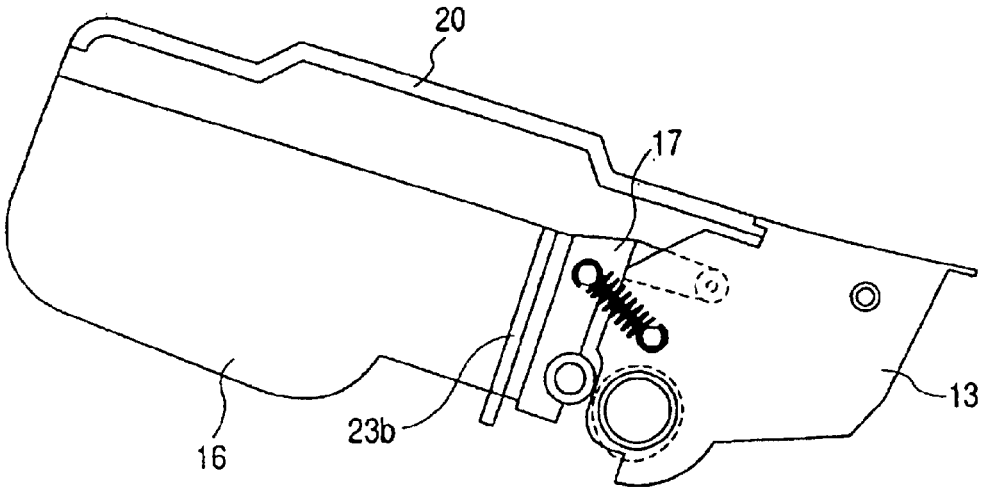
FIG. 7 shows a state of movement between the frames of the process cartridge in FIG. 1.

FIGS. 3 and 4 are perspective views of a frame configuration. FIG. 3 shows a state before a frame is assembled, and FIG. 4 shows a state after the frame is assembled.

The cartridge 15 includes three frames: a cleaning frame 13 that integrally supports the photosensitive drum 11, the electrifying roller 12 and the cleaning blade 14; a developing frame 17 that integrally supports the developing roller 18 and the developing blade (not shown); and a toner containing frame 16 that contains the toner. The cleaning frame 13 and the toner containing frame 16 are placed opposite each other, and the developing frame 17 is placed between the cleaning frame 13 and the toner containing frame 16.

The three frames are secured to side covers 19, 20 at both sides of the frames so as to be integrally supported, and form the process cartridge as a unit.

(1) Cleaning Frame 13

The cleaning blade 14 is secured by a screw or the like to the cleaning frame 13, and the electrifying roller 12 is rotatably supported at cored bars on ends thereof via bearing members (not shown).

The photosensitive drum 11 is rotatably supported at flanges 11*a*, 11*b* on both ends via bearing members 22.

(2) Toner Containing Frame 16

The toner containing frame 16 contains the toner together with a toner conveying member (not shown). The developing frame 17 will be described later in detail. One side cover 19 on a non-driven side is sized to cover a main section of the cartridge 15, and placed on one end in a longitudinal direction of the cartridge to integrally support the cleaning frame 13 and the toner containing frame 16 from both sides.

A hole 19*a* of the side cover 19 is positioned coaxially with a center of the photosensitive drum 11 in the cleaning frame 13. At this time, the side cover 19 can be accurately positioned via the bearing member 22. A positioning portion 19*b* provided as far away as possible from the photosensitive drum 11 together with a positioning portion 13*b* provided on a side of the cleaning frame 13 determines a position in a rotational direction, and they are secured by several screws.

The toner containing frame 16 has, on one end surface thereof, positioning portions 16*a* and 16*b*. The positioning portions 16*a* and 16*b* and positioning portions 19*c* and 19*d* provided on the side cover 19 position the frame 16 and the side cover 19. Then, the side cover 19 is secured to the frame 16 by several screws.

The other side cover 20 on a driven side positions the developing frame 17 by the below-described method.

The bearing member 22 also serves to position the cartridge 15 in the image forming apparatus. In order to supply the toner from the frame 16 to the developing roller 18, the frame 16 and the frame 17 have an opening 16*c* and an opening 17*a*, respectively.

The frame 17 and the frame 16 are connected so as to connect the openings, by a seal member 21 having an opening.

The frame 16 is positioned by the side covers 19, 20. The frame 17 is positioned by the frame 13. Thus, dimensional errors of the frame 17 and the frame 16 may cause distortion of either of them. Therefore, the seal member 21 is made of a flexible material.

Such a configuration causes a load by the toner to be applied on the side cover rather than on the developing roller, even if the quantity of toner increases, as described above. This provides a stable image without applying unnecessary loads on the photosensitive drum.

Further, connecting the frames at the sides thereof allows positioning of the frames by the side covers, and allows accurate connection to be made.

[Configuration of Developing Frame]

In the developing frame 17, the developing roller 18 including a magnetic roller 26, the developing blade and a magnetic seal (not shown) are provided.

The magnetic roller 26 is supported by an inner diameter of the developing roller 18 to keep a gap from the developing roller 18. Power is supplied to the developing roller 18 by providing an electrical contact inside the developing roller 18. These will be described later in detail. The developing roller 18 also has, on a top thereof, an abutting roller (not shown) to keep a constant distance from the photosensitive drum 11.

The developing frame 17 is supported to oscillate around a suspension hole 17*d* provided on the driven side (the right in FIG. 3) of the developing roller 18 so that the center of the developing roller 18 moves toward the center of the photosensitive drum 11.

Specifically, the developing frame 17 having the developing roller 18 is placed to oscillate around the suspension hole 17*d* on the driven side of the cleaning frame 13. As described above, the cleaning frame 13 and the toner containing frame 16 are secured without movement relative to each other. Thus, the developing frame 17 is movable relative to the toner containing frame 16.

Further, on the non-driven side of the developing frame 17, a sleeve member 17*e* for pressing the developing roller 18 is provided on a longitudinal central axis of the developing roller 18 (one end of the magnetic roller 26 fits into the sleeve member 17*e*). Then, the sleeve member 17*e* is pressured in a central direction of the photosensitive drum 11.

The sleeve member 17*e* is inserted into a long groove 19*e* (in this embodiment, a linear slot substantially parallel to the central direction of the photosensitive drum 11) as a guide provided in one side cover 19, and is movable in the central direction of the photosensitive drum 11. In the long groove 19*e*, a coil spring 43*b* having an abutting piece 43*a* at a tip thereof is placed so as to press the sleeve member 17*e* toward the photosensitive drum 11.

The groove 19*e* also serves to regulate the moving direction of the developing roller 18 for positioning.

When a driving force acts on the developing apparatus and the photosensitive drum, the force causes driving gears provided on the photosensitive drum 11 and the developing roller 18 (the gear of the photosensitive drum 11 and the gear of the developing roller 18 mesh with each other, though they are not shown) to engage each other around the suspension hole 17*d*, and the force does not cause the photosensitive drum 11 and the developing roller 18 to separate from each other. The sleeve member 17*e* also always presses the developing roller 18 toward the photosensitive drum 11.

Specifically, according to the embodiment, the developing frame 17 and the toner containing frame 16 are movable relative to each other, and are connected by the seal member 21 that absorbs movement of both to prevent leakage of the toner. The seal member 21 is desirably formed to have less rigidity that prevents movement of the developing apparatus. The seal member 21 is desirably formed to have at least one or more folds, or is formed into bellows.

The seal member 21 according to the embodiment is made of elastomer with two folds (not shown) to reduce rigidity. However, flexible materials such as urethane foam, low-hardness rubber, or silicone may be selected. In this case, if its rigidity is slight, similar advantages can be obtained without folds or bellows.

[Power Supplying Configuration of Developing Roller and Supporting Configuration of Magnetic Roller]

Now, a power supplying configuration of the developing roller and a supporting configuration of the magnetic roller according to the embodiment will be described in detail.

Figure 8A:
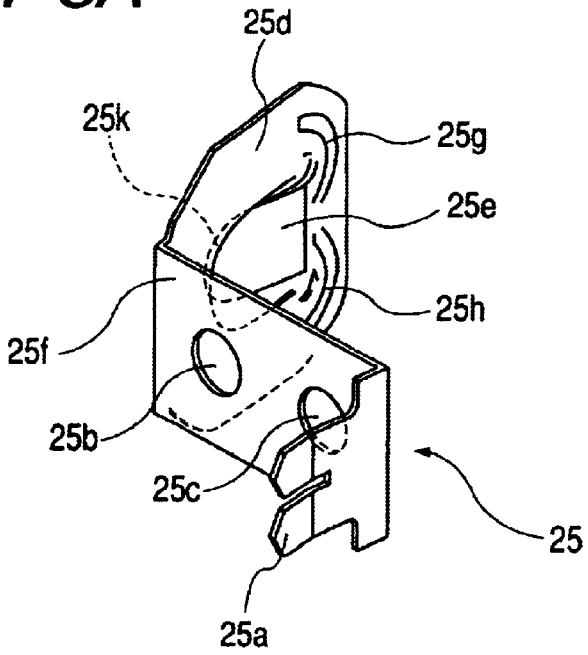
FIG. 8A is a perspective view of a sleeve contact plate.
Figure 8B:
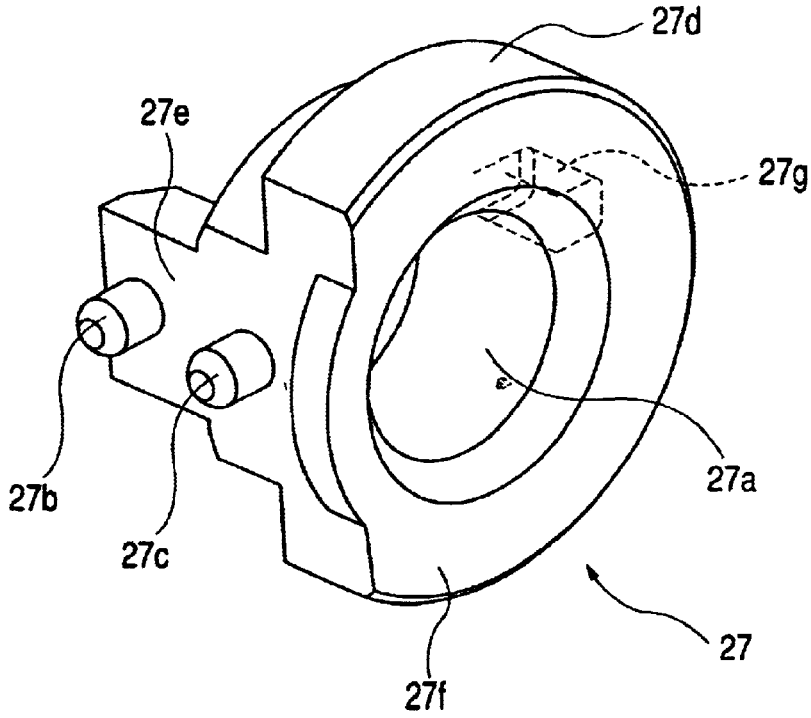
FIG. 8B is a perspective view of a magnetic roller bearing.
Figure 9:
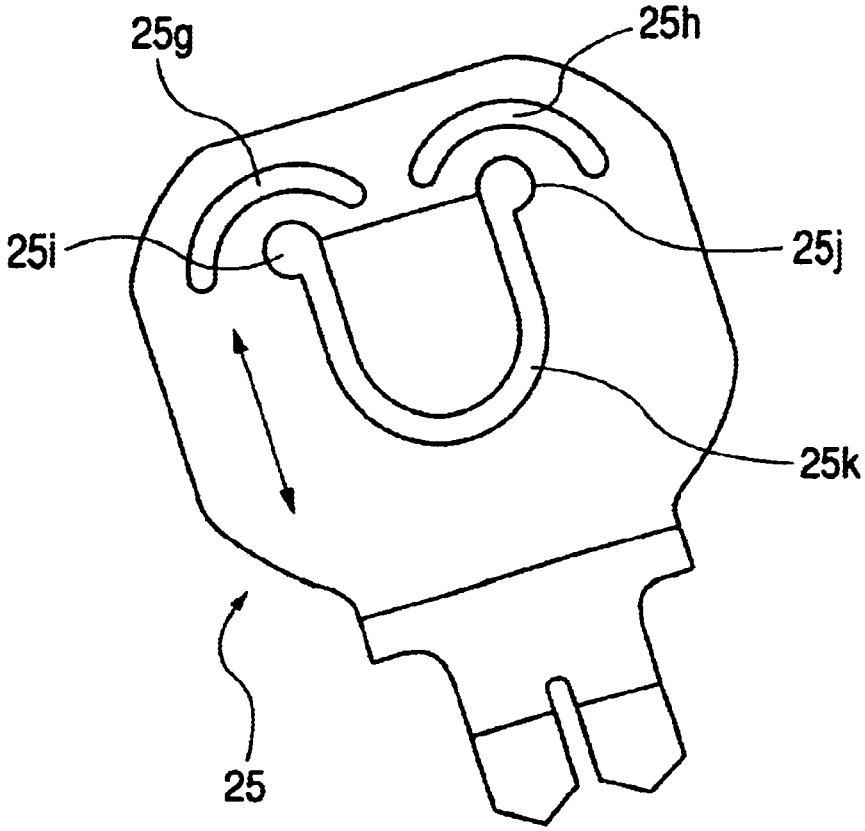
FIG. 9 shows the appearance of a contact portion side, which contacts an electrode axis, of the sleeve contact plate.
Figure 10:
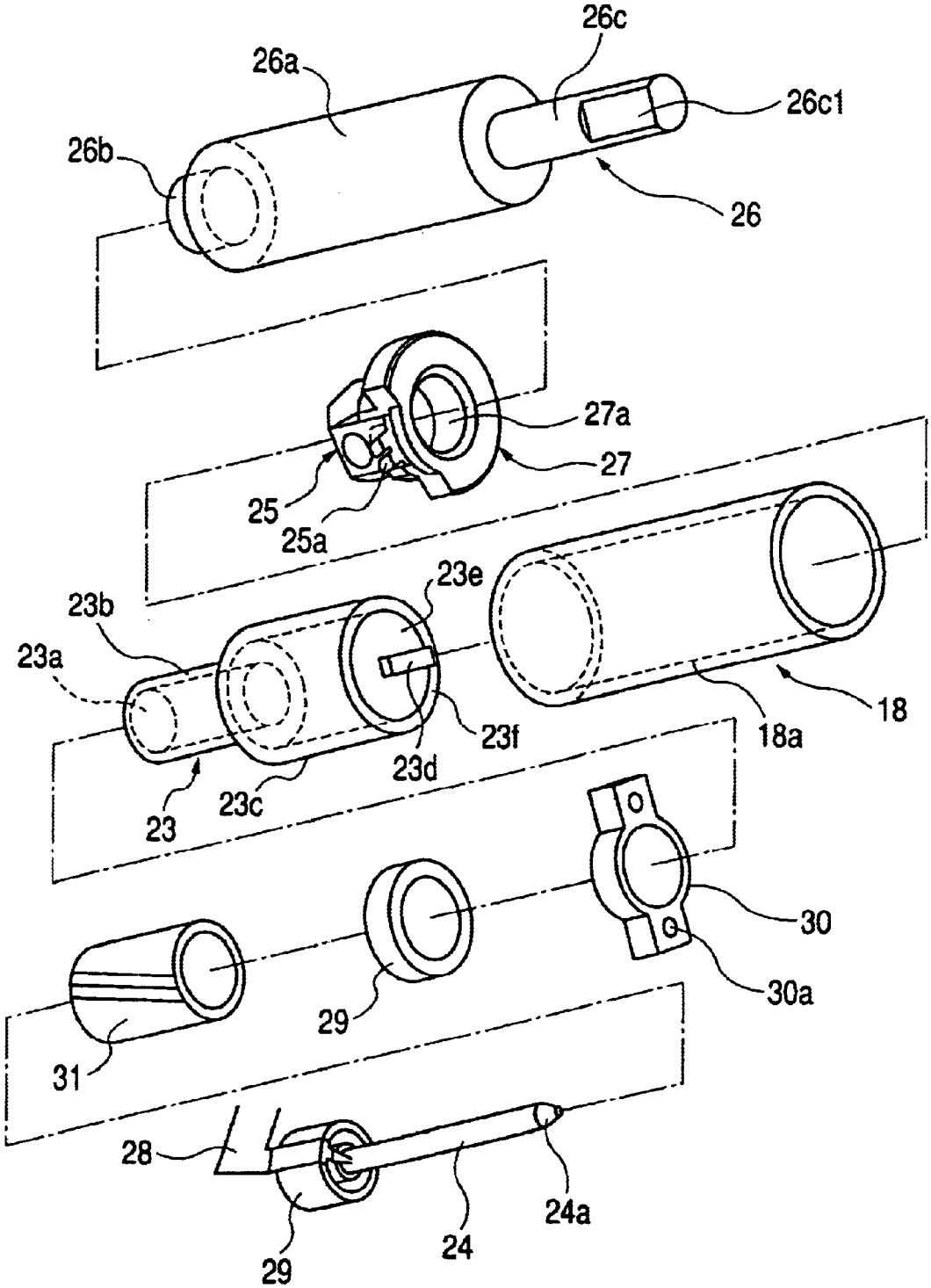
FIG. 10 is an exploded perspective view of a developing roller according to the embodiment of the invention.
Figure 11:
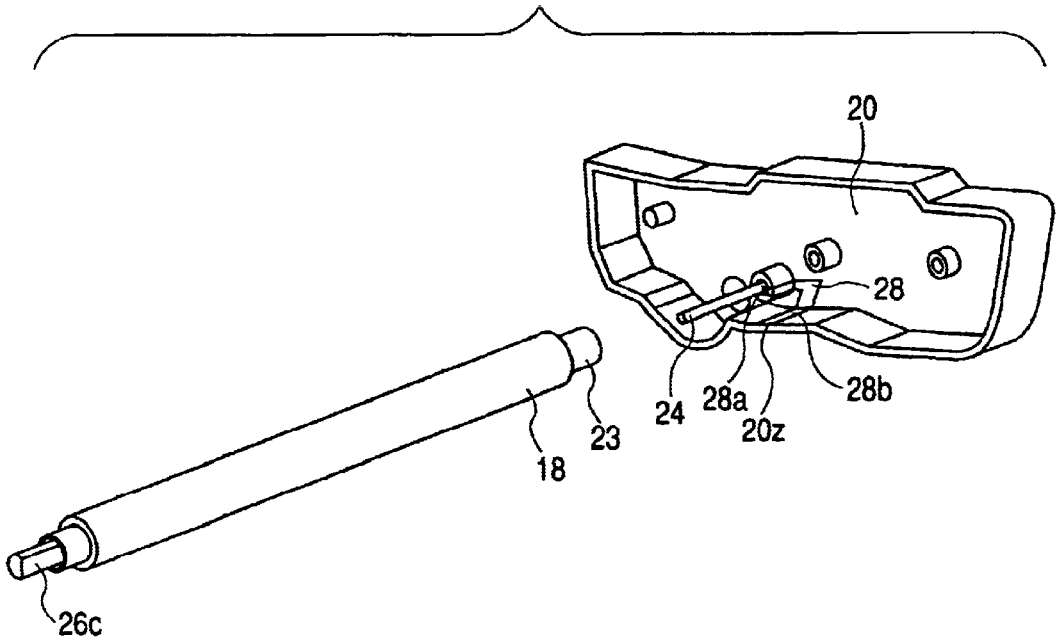
FIG. 11 is an exploded perspective view of the developing roller and the side cover according to the embodiment of the invention.
Figure 12A:
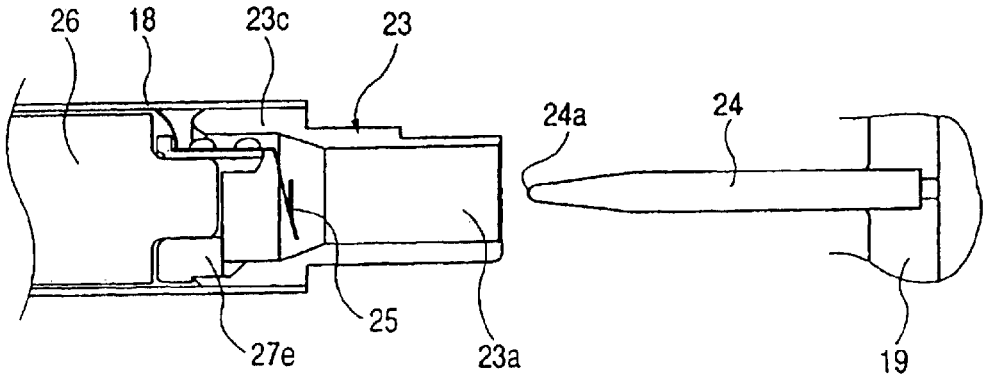
FIGS. 12A and 12B show, in vertical section, the assembling order of the developing roller in FIG. 9.
Figure 12B:
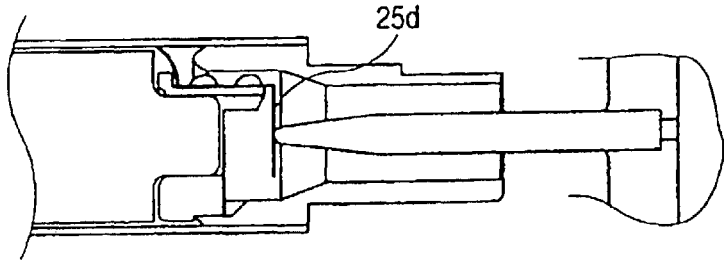

FIGS. 8A and 8B are perspective views of the appearances of a sleeve contact plate 25 functioning as an electrode member and a magnetic roller bearing 27 according to the embodiment, FIG. 9 shows the appearance of a contact portion, which contacts the bearing 27, of the contact plate 25, viewed from the central axis of the developing roller 18, FIG. 10 is an exploded perspective view of members constituting the developing roller 18 before assembly according to the embodiment, FIG. 11 is an exploded perspective view of the developing roller 18 and the side cover before assembly, and FIGS. 12A and 12B are sectional views of the developing roller taken along the central axis.

The developing roller 18 is formed into a cylindrical member made of a metal material such as aluminum or stainless steel, as shown in FIG. 10. The developing roller 18 has an outer diameter of about 16 to 20 mm, and a thickness of about 0.5 to 1 mm. The surface of the developing roller 18 is carbon coated or subjected to a blast to increase the electrostatic property of a developer. In the embodiment, the developing roller 18 is only carbon coated. The developing roller 18 has, at both ends thereof, press fitting portions 18*a* for fixedly press fitting a below-described sleeve flange 23 into an inner periphery thereof.

As shown in FIG. 10, the sleeve flange 23 is a stepped cylindrical member made of a metal material such as aluminum or stainless steel, and fixedly press fitted into the ends of the developing roller 18. FIG. 10 shows the flange 23 only at the end on the driven side, but a flange 23 is similarly provided on the non-driven side.

The flange 23 has a stepped shape formed by a large diameter portion and a small diameter portion. The large diameter portion is a press fitting portion 23*c* fixedly press fitted into the inner periphery of the developing roller 18. The press fitting causes the flange 23 to be secured to the developing roller 18 so as not to rotate.

If the outer diameter of the developing roller 18 and the flange 23 are not exactly coaxial, the density of an image tends to be uneven. Thus, the developing roller 18 and the flange 23 are accurately secured.

A securing portion 23*e* that secures the bearing 27 and a groove 23*d* that regulates rotation of the bearing 27 are provided on the inner periphery of the press fitting portion 23*c* and in a position substantially corresponding to the axial direction of the developing roller 18.

A flange outer diameter portion 23*b* coaxial with the press fitting portion 23*c* and having a smaller outer diameter is provided outside the press fitting portion 23*c* of the flange 23.

A distance regulating member 29 for regulating the distance between the developing roller 18 and the photosensitive drum 11, a sleeve bearing 30 rotatably supported by the developing frame 17, and a sleeve gear 31 to which the driving force is transferred from the photosensitive drum 11 to rotate the developing roller 18, fit over the flange outer diameter portion 23*b*.

The sleeve bearing 30 is secured to the developing frame 17 by a support hole 30*a*. The sleeve gear 31 is secured to the developing roller 18 so as not to rotate. A through hole 23*a* is provided in the inner periphery coaxially with the outer diameter portion 23*b*. A below-described electrode axis 24, made of metal in an axial shape, passes through the through hole 23*a*, and conduction occurs therein. An end surface 23*f* is a surface for axially positioning a below-described magnetic roller bearing.

The magnetic roller 26 has axis supports 26*b*, 26*c* on both sides of a larger diameter portion 26*a*, as shown in FIG. 10. The larger diameter portion 26*a* is included in the developing roller 18, and has a plurality of magnetic poles circumferentially on a surface thereof. Generally, one of the magnetic poles is placed substantially opposite the photosensitive drum 11. The other magnetic poles are appropriately arranged, and in this embodiment, four poles are provided.

The distance between the surface of the larger diameter portion 26*a* and the surface of the developing roller 18 are kept constant for a stable magnetic force on the developing roller 18. In order to keep the constant distance, one axis support 26*c* is supported by the side cover 19 shown in FIG. 3 (one axis support 26*c* is supported by fitting into the sleeve member 17*e* for pressing the developing roller so as not to rotate, and by the sleeve member 17*e* fitting into the long groove 19*e* of the side cover 19).

At this time, a D-cut portion 26*c*1 formed in one axis support 26*c* fits into a fitting hole with a D-shaped inner periphery of the sleeve member 17*e*. This stabilizes the circumferential arrangement of the magnetic poles.

The other axis support 26*b* is supported by the magnetic roller bearing 27 fitting into the securing portion 23*d* of the flange 23.

The bearing 27 is formed as a D-cut mold member as shown in FIGS. 8B and 10.

The bearing 27 has, on an outer peripheral surface thereof, an outer diameter portion 27*d*, a rotation stop 27*g* formed as a dowel, and a D-cut surface 27*e*. The outer diameter portion 27*d* fits into the securing portion 23*e* of the flange 23 shown in FIG. 10. The rotation stop 27*g* engages the groove 23*d* and rotates with the rotation of the flange 23.

Rotation stops 27*b* and 27*c* functioning as dowels, are provided on the D-cut surface 27*e* and protrude outward perpendicularly to the axis of the developing roller 18, and the D-cut surface 27*e* support and position the below-described sleeve contact plate 25.

A positioning hole 27*a* that positions the magnetic roller 26 is provided in the inner periphery of the bearing 27. The hole has a diameter of 5 to 10 mm, and a depth of 3 to 8 mm. For accurate positioning of the magnetic roller 26, the accuracy of the inner diameter is in class 8 or 9, and surface roughness is about Ra 0.8 mm.

The magnetic roller 26 is secured and does not rotate. The bearing 27 rotates together with the developing roller 18. Thus, the magnetic roller 26 slides in the positioning hole 27*a*. For this purpose, the bearing 27 is made of a material having a good sliding property on the magnetic roller 26, such as PPS. In order to determine the axial position of the bearing 27 with respect to the developing roller 18, the bearing 27 has, on an end surface thereof, a collar 27*f* abutting against the end surface 23*f* of the flange 23.

The contact plate 25 is formed into a substantially Z-shape by providing substantially perpendicularly bent pieces on both sides of a linear portion 25*f*, as shown in FIGS. 8A and 10. The contact plate 25 is formed of a conductive sheet metal member (for example, a Cu alloy or an Fe alloy such as SUS) having a thickness of 0.1 to 0.3 mm. The contact plate 25 is secured to the magnetic roller bearing 27 at the linear portion 25*f*. Specifically, an engagement hole 25*b* (slot) and an engagement hole 25*c* functioning as engagement portions provided on the linear portion 25*f* of the contact plate 25 engage the dowels 27*b* and 27*c*, respectively, as engagement portions of the bearing 27. Then, the linear portion 25*g* contacts the D-cut surface 27*f*. Thus, the contact plate 25 is positioned on the bearing 27.

The dowels 27*b* and 27*c* are secured to the engagement holes 25*b* and 25*c* by thermal welding, ultrasonic welding or bonding. At this time, the dowels 27*b* and 27*c* of the bearing 27 are collapsed to be in a substantially hemispherical shape. The dowels 27*b* and 27*c* are provided on the D-cut surface 27*e*. Thus, the dowels 27*b* and 27*c* in the substantially hemispherical shape after welding do not protrude beyond the outer diameter portion 27*d*. Therefore, the securing portion 23*e* as the inner peripheral surface of the flange 23 may be formed into a circle. This eliminates costs for complex working.

The contact plate 25 has an arm 25*a* abutting against the inner peripheral surface of the developing roller 18, and the arm 25*a* electrically connects to the developing roller 18. As shown in FIG. 12A, the arm 25*a* is provided against a direction in which the bearing 27 is drawn from the flange 23. This prevents the bearing 27 from being dropping off the flange 23.

As described above, the collar 27*f* of the bearing 27 abuts against the end surface 23*f* of the flange 23. Thus, the axial positions of the bearing 27 and the contact plate 25 are completely determined with respect to the developing roller 18.

In one bent piece 25*d* of the contact plate 25, a small piece 25*e*, which is formed by a groove and is elastically deformable, is provided in a cut and raised (bent and raised) manner. The small piece 25*e* elastically abuts against the below-described electrode axis 24. The elastically deformable portion is a range from one bent piece 25*d* to the cut and raised small piece 25*e*.

The spring constant is preferably small so as to keep constant contact pressure on a contact portion of the electrode axis 24, even if axial displacement of the developing roller 18 causes displacement of the electrode axis 24 and the small piece 25*e*. For this purpose, a longer spring portion (one bent piece 25*d*, the small piece 25*e* or the like of the contact plate 25) is effective.

The spring portion must be long to some extent against flattening. In a sectional direction (in a state where the contact plate 25 is viewed in the axial direction), however, the spring portion is deformable only within a narrow range with a diameter of 10 to 15 mm. The axial length cannot be increased for a reduction in size of the entire apparatus C. Thus, a U-shape groove 25*k* is provided in the spring portion to increase the length of the spring by one bent piece 25*d* (circumferential portion) and the small piece 25*e*.

One bent piece 25*d* is previously formed into a Z-shape so as to fit into a plane in a sleeve axial direction when the below-described electrode axis 24 contacts the small piece 25*e*.

The electrode axis 24 stands on the inside of the side cover 20 axially inward and coaxially with the developing roller 18, as shown in FIGS. 10 and 11. The electrode axis 24 is made of plated iron or stainless steel, has an outer diameter of about 2 to 6 mm, and insert molded together with the side cover. Alternatively, the electrode axis 24 is later press fitted and secured so as not to rotate or be drawn.

When the side cover 20 is assembled, the electrode axis 24 passes through the through hole 23*a* of the flange 23, the tip 24*a* of the axis 24 bends the small piece 25*e* of the sleeve contact plate 25, and the small piece 25*e* abuts against the axis 24 with a certain abutting pressure. The tip 24*a* of the axis 24 is spherical, and reliably abuts against the small piece 25*e* of the sleeve contact plate 25 at one point. This is for reliably conducting the axis 24, which is not rotated though the sleeve contact plate 25 is rotated, at the tip thereof as a sliding portion. Further, wear caused by sliding is minimized. For this purpose, conductive grease is preferably placed on the tip 24*a* of the axis 24. The axis 24 is reliably prevented from making contact with the inner periphery of the through hole 23*a* of the flange 23. This is for preventing interference of the position of the developing roller 18. A contact plate 28 connecting to the apparatus body C contacts a base of the electrode axis 24.

The contact plate 28 is a leaf spring member attached to the side cover 20, made of metal (SUS, a Cu alloy or the like), and having a thickness of 0.1 to 0.3 mm, as shown in FIGS. 10 and 11. The contact plate 28 has a contact portion 28*b* so as to be exposed to the outside by a hole 20*z* provided in the side cover 20. The contact portion 28*b* electrically connects to an electrode member (not shown) provided in the apparatus body C when the cartridge 15 is attached to the image forming apparatus body C.

A tip 28*a* of the contact plate 28 connecting to the apparatus body C electrically connects to the axis 24. The axis 24 and the contact plate 28 are connected by fastening, or by providing an abutting portion on the contact plate 28 to elastically abut the axis 24 against the abutting portion.

The axis 24 may be connected to a conductive member (for example, a SUS plate) by fastening or the like, and the conductive member and the axis may be electrically connected. Further, the axis 24 and the contact plate 28 may be integrally formed to be attached to the side cover.

The above-described configuration will be repeatedly described in the assembling order based on FIGS. 10 and 12. The press fitting portion 23*c* of the flange 23 is press fitted into the press fitting portion 18*a* of the developing roller 18, and completely secured. Then, the bearing 27 to which the contact plate 25 is secured is inserted into the developing roller 18 from a side opposite the flange 23 being press fitted, and inserted until the collar 27*f* abuts against the end surface 23*f* of the flange 23. At this time, as described above, the spring force of the arm 25*a* determines the exact position of the bearing. Then, the magnetic roller 26 is inserted, and a sleeve flange (not shown) on the opposite side is attached, and then the developing roller 18 is completed.

Next, the distance regulating member 29, the sleeve bearing 30 and the sleeve gear 31 are successively assembled to be integrated into the developing frame (not shown). This state is shown in FIG. 12A. In this state, one bent piece 25*d* and the small piece 25*e* of the sleeve contact plate 25 are opened.

Then, assembling the side cover 20 causes the tip 24*a* of the axis 24 to contact the small piece 25*e* of the sleeve contact plate 25. In a state where the side covers 19, 20 are completely assembled, the bent piece 25*d* and the small piece 25*e* are in substantially the same plane, viewed from the axial direction, thus saving space in the axial direction.

The contact plate 28, the electrode axis 24, the sleeve contact plate 25 and the developing roller 18 are connected from a high pressure power supply contact (not shown) of the image forming apparatus body C to reliably provide conduction.

The contact portions are placed near the outside and the inside in the axial direction of the bearing of the magnetic roller 26, thus saving space in the axial direction. The contact portion between the electrode axis 24 and the contact plate 25, which is the only sliding contact portion, is included in the flange 23 to prevent contamination with dust or the like and provide more stable contact properties.

The magnetic roller 26 is positioned by the bearing 27 secured to the inner diameter of the flange 23. This allows accurate positioning on the surface of the developing roller 18.

Figure 13A:
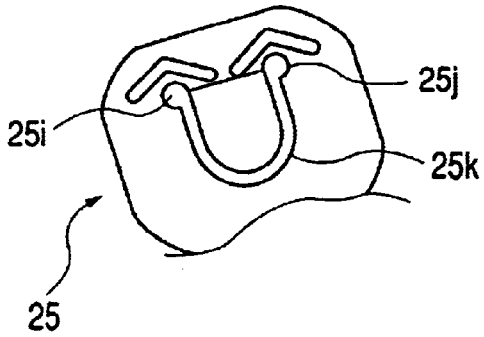
FIGS. 13A, 13B, 13C, 13D, 13E and 13F show the appearances of a rib provided in the sleeve contact plate according to the embodiment of the invention.
Figure 13B:
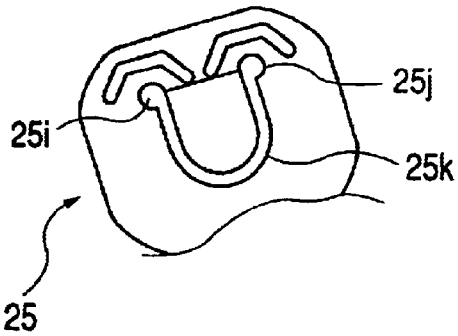
Figure 13C:
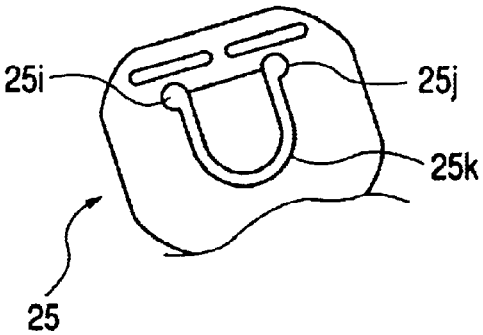
Figure 13D:
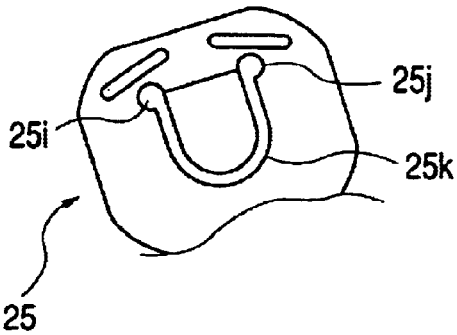
Figure 13E:
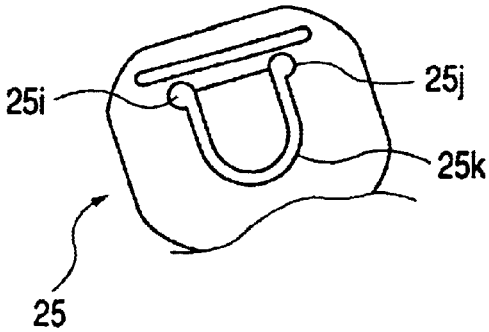
Figure 13F:
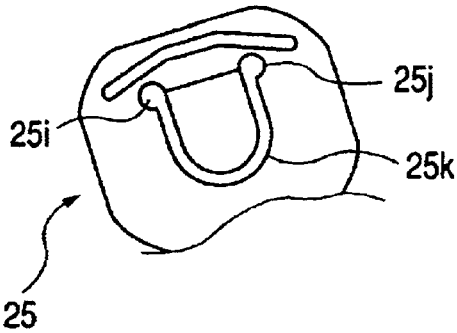

Now, the contact plate 25 will be further described. The bent piece 25*d* has the U-shaped groove 25*k* as shown in FIG. 9, and ends 25*i* and 25*j* thereof are in an arcuate shape with a diameter larger than the width of the groove. Further, ribs 25*g* and 25*h* in a bead shape are provided so as to surround the ends 25*i* and 25*j*. As described above, if the electrode axis 24 contacts the small piece 25*e* of the contact plate 25*d*, the contact plate 25 is elastically deformed into a state in FIG. 12B from a state in FIG. 12A. Thus, contact occurs at the contact portion with constant abutting pressure to provide reliable conduction. At this time, stress concentrates near the ends 25*i* and 25*j* of the U-shaped groove 25*k* in the contact plate 25 to apply maximum stress. In the embodiment, the ends 25*i* and 25*j* of the U-shaped groove are in an arcuate shape with a diameter larger than the width of the groove. This allows the stress applied on the ends 25*i* and 25*j* to be scattered to reduce the maximum stress. The width of the U-shaped groove 25*k* may be narrow, and there is no need for increasing the width of the bent piece 25*d*. However, for reliable conduction between the contact plate 25 and the electrode axis 24, the contact plate 25 desirably contacts the electrode axis 24 at a fixed pressure or more. Thus, a reduction in the reaction force against pressing of the electrode axis 24 is not preferable. In this embodiment, the ribs 25*g* and 25*h* are provided so as to surround the ends 25*i* and 25*j* to keep the reaction force against the electrode axis 24, and scatter the reaction force on the ends 25*i* and 25*j* to reduce the maximum stress. The ribs 25*g* and 25*h* in the bead shape are desirably substantially perpendicular to a rolled direction (the direction of arrow in FIG. 9 in the embodiment) of the contact plate 25 as the sheet metal member. The ribs 25*g* and 25*h* may protrude toward either the contact portion side with the electrode axis 24 or the opposite side, and substantially the same advantages can be obtained. In the embodiment, the ribs 25*g* and 25*h* are in the arcuate shape, but may be in a polygonal shape as shown in FIGS. 13A and 13B. Some advantages can be obtained if linear ribs as shown in FIGS. 13C and 13D are provided near the ends 25*i* and 25*j*. In the embodiment, the ribs are provided near the two ends of the groove of the contact plate 25 as the electrode member. However, a plurality of ribs may be connected into one as shown in FIGS. 13E and 13F. In the above-described configuration, the electrode axis 24 is desirably reliably attached to the center of rotation of the contact plate 25 according to a rotation cycle of the developing roller 18. However, the electrode axis 24 is secured to the side cover forming the housing of the cartridge 15. The developing roller 18 having the contact plate 25 is held to permit oscillating in the housing via a developing device. Thus, it is difficult to reliably secure the electrode axis 24 to the center of rotation of the contact plate 25, because of tolerances or the like. If the contact portion between the electrode axis 24 and the contact plate 25 is slightly offset from the center of rotation of the contact plate 25, the contact plate 25 is vibrated axially of the developing roller 18 according to the rotation cycle of the developing roller 18. In this embodiment, the above-described configuration is added to the contact plate 25 to allow scattering of the stress on the ends 25*i* and 25*j* of the U-shaped groove, which may be fatigued with the vibration, while keeping the reaction force against the pressing of the electrode axis 24. The width of the groove 25*k* may be narrow, thus increasing the life and reliability of the contact plate 25 without changing the space of the contact portion. For the vibration on the contact plate 25, burrs caused in a production stage in press working or the like may cause fatigue destruction, but face cutting of the ends 25*i* and 25*j* of the U-shaped groove allows removal of the burrs to further increase reliability.

The above-described embodiment provides the process cartridge 15, which is detachably attachable to the image forming apparatus body C, wherein the conductive sheet metal member (the contact plate 25) is configured so that a part thereof has, in the axial center, the contact portion (the small piece 25*e*) that is formed by a hole 25*k* and is elastically displaceable in the axial direction. The end of the hole 25*k* is larger than the width of the groove, and the ribs 25*g* and 25*h* are provided near the end of the hole 25*k* so as to surround the end of the hole 25*k*. Further, the process cartridge 15 has a first electrode member (the sleeve contact plate 25) that is supported in the developing roller 18 and is in a conductive relationship with the developing roller 18. The process cartridge 15 has a second electrode member (the electrode axis 24) that is axially inserted into the developing roller 18 to contact the contact portion (the small piece 25*e*) of the first electrode member, and provided on the housing of the cartridge 15 connected to an external contact portion (not shown).

According to the above-described embodiment, for the electrode member having, in a part of the conductive metal sheet member, the small piece that is formed by the groove and is elastically deformable, the end of the groove is larger than the width of the groove, and bead working is performed around the end of the groove. This allows a reduction in the stress on the end of the groove where the heaviest load is applied without any reduction of reaction force to the pressing, thus reliably increasing the life.

As described above, the invention increases reliability of the electrode member.

What is claimed is:

1. An electrode member for supplying power from an image forming apparatus body to a developing roller of a process cartridge, when the process cartridge, detachably attachable to the image forming apparatus body, is attached to the image forming apparatus body, said electrode member comprising:

a conductive substrate having a hole therein, wherein the hole includes a groove and an end portion, wherein the width of the end portion of the hole is larger than the width of the groove of the hole;

an elastic portion bent and raised along said hole to permit an electrode to contact said elastic portion;

a rib provided opposite and along the end portion of said hole;

an engagement hole positioned and configured to permit mounting of said electrode member to a bearing of the developing roller; and a contact portion contacting an inner surface of the developing roller, when said electrode member is mounted to the bearing.

2. The electrode member according to claim 1, wherein said rib is placed so as to surround a part of the end portion.

3. The electrode member according to claim 1 or 2, wherein said electrode member further includes:

a mounting portion having said engagement hole; and a bent portion bent from said mounting portion, wherein said mounting portion is bent from said substrate, and wherein said bent portion has said contact portion.

4. The electrode member according to claim 3, wherein said end portion of said hole is a face cutting end portion on which face cutting has been performed.

5. A process cartridge detachably attachable to an image forming apparatus body, comprising:

an electrophotographic photosensitive member;

a developing roller that develops a latent image formed on said electrophotographic photosensitive member; and an electrode member configured and positioned to supply power from the image forming apparatus body to said developing roller, when said process cartridge is attached to the image forming apparatus body, wherein said electrode member comprises:

a conductive substrate having a hole therein, wherein the hole includes a groove and an end portion, wherein the width of the end portion of the hole is larger than the width of the groove of the hole;

an elastic portion bent and raised along said hole to permit an electrode provided on a cartridge frame of said process cartridge to contact said elastic portion;

a rib provided opposite and along the end portion of said hole;

an engagement hole positioned and configured to permit mounting of said electrode member to a bearing of said developing roller; and a contact portion contacting an inner surface of said developing roller.

6. The process cartridge according to claim 5, wherein said rib is placed so as to surround a part of the end portion.

7. The process cartridge according to claim 5 or 6, wherein said electrode member further comprises:

a mounting portion having said engagement hole; and a bent portion bent from said mounting portion, wherein said mounting portion is bent from said substrate, and wherein said bent portion has said contact portion.

8. The electrode member according to claim 7, wherein said end portion of said hole is a face cutting end portion on which face cutting has been performed.

9. An image forming apparatus to which a process cartridge is detachably attachable, and that forms an image on a recording medium, comprising:

(i) an attachment portion configured to detachably attach the process cartridge comprising: an electrophotographic photosensitive member; a developing roller that develops a latent image formed on the electrophotographic photosensitive member; and an electrode member configured and positioned to supply power from an image forming apparatus body to the developing roller, when the process cartridge is attached to the image forming apparatus body, wherein the electrode member comprises: a conductive substrate having a hole therein, wherein the hole includes a groove and an end portion, wherein the width of the end portion of the hole is larger than the width of the groove of the hole; an elastic portion bent and raised along the hole to permit an electrode provided on a cartridge frame of the process cartridge to contact the elastic portion; a rib provided opposite and along the end portion of the hole; an engagement hole positioned and configured to permit mounting of the electrode member to a bearing of the developing roller; and a contact portion contacting an inner surface of the developing roller; and (ii) a conveying device that conveys the recording medium.

* * * * *